US009251780B2

(12) United States Patent
Yamaguchi et al.

(10) Patent No.: US 9,251,780 B2
(45) Date of Patent: Feb. 2, 2016

(54) SOUND OUTPUT DEVICE

(71) Applicant: KONICA MINOLTA, INC., Tokyo (JP)

(72) Inventors: Masahiro Yamaguchi, Toyokawa (JP); Hiroaki Umemoto, Neyagawa (JP); Takayuki Ito, Nagoya (JP)

(73) Assignee: KONICA MINOLTA, INC., Tokyo (JP)

( * ) Notice: Subject to any disclaimer, the term of this patent is extended or adjusted under 35 U.S.C. 154(b) by 310 days.

(21) Appl. No.: 13/717,609

(22) Filed: Dec. 17, 2012

(65) Prior Publication Data

US 2013/0163779 A1 Jun. 27, 2013

(30) Foreign Application Priority Data

Dec. 26, 2011 (JP) ..... 2011-282602

(51) Int. Cl.
*H04R 3/02* (2006.01)
*G10K 11/175* (2006.01)
*H04H 40/72* (2008.01)

(52) U.S. Cl.
CPC ..... *G10K 11/175* (2013.01)

(58) Field of Classification Search
CPC ..... G10K 11/175; H04R 3/04; H04R 3/002; H03G 3/32
USPC ..... 381/73.1, 106, 57, 94.1
See application file for complete search history.

(56) References Cited

U.S. PATENT DOCUMENTS

| | | | | |
|---|---|---|---|---|
| 5,867,748 | A * | 2/1999 | Takahashi et al. | 399/1 |
| 2002/0150261 | A1* | 10/2002 | Moeller et al. | 381/73.1 |
| 2011/0123037 | A1* | 5/2011 | L'Esperance | 381/73.1 |

FOREIGN PATENT DOCUMENTS

| | | | |
|---|---|---|---|
| JP | 03038698 | A | 2/1991 |
| JP | 04080798 | A | 3/1992 |
| JP | 09-193506 | | 7/1997 |
| JP | 09319389 | A | 12/1997 |
| JP | 10124072 | A | 5/1998 |
| JP | 2005084645 | A | 3/2005 |
| JP | 2008-209785 | | 9/2008 |
| JP | 2011154125 | A | 8/2011 |
| JP | 2011191636 | A | 9/2011 |

OTHER PUBLICATIONS

"Japanese Office Action dated Mar. 4, 2014 in counterpart Japanese Application No. 2011-282602".
Japanese Office Action dated Dec. 16, 2014, issued in counterpart Japanese Application No. 2011-282602.

* cited by examiner

*Primary Examiner* — Paul S Kim
*Assistant Examiner* — Norman Yu
(74) *Attorney, Agent, or Firm* — Holtz, Holtz & Volek PC

(57) ABSTRACT

A sound output device for masking an operation sound generated by equipment, having: an operation determining unit that determines an operation mode to be executed by the equipment; and a sound output unit that outputs a masking sound on the basis of the operation mode determined by the operation determining unit, the masking sound changing at least in sound pressure level over time.

10 Claims, 9 Drawing Sheets

FIG.6

11

| EQUIPMENT | OPERATION MODE | MASKING SOUND |
|---|---|---|
| IMAGE FORMING APPARATUS | SINGLE PRINT MODE | MASKING SOUND M1 |
| | CONTINUOUS PRINT MODE | MASKING SOUND M2 |
| PERIPHERAL EQUIPMENT | ADF | MASKING SOUND M3 |
| | FINISHER | MASKING SOUND M4 |
| IMAGE FORMING APPARATUS + PERIPHERAL EQUIPMENT | CONTINUOUS PRINT MODE + FINISHER | MASKING SOUND M5 |

11

| EQUIPMENT | OPERATION MODE | MASKING SOUND |
|---|---|---|
| IMAGE FORMING APPARATUS | SINGLE PRINT MODE | MASKING SOUND M1 |
| | CONTINUOUS PRINT MODE | MASKING SOUND M2 |
| PERIPHERAL EQUIPMENT | ADF | MASKING SOUND M3 |
| | FINISHER | MASKING SOUND M4 |
| IMAGE FORMING APPARATUS + PERIPHERAL EQUIPMENT | CONTINUOUS PRINT MODE + ADF | MASKING SOUND M6 |

SOUND OUTPUT DEVICE

CROSS-REFERENCE TO RELATED APPLICATION

This application is based on Japanese Patent Application No. 2011-282602 filed on Dec. 26, 2011, the content of which is incorporated herein by reference.

BACKGROUND OF THE INVENTION

1. Field of the Invention

The present invention relates to a sound output device that outputs a masker (masking sound) for masking an operation sound generated by equipment.

2. Description of Related Art

Conventionally, to deal with an operation sound generated by an image forming apparatus or suchlike, a so-called "noise reduction technology" for reducing operation sounds is employed. Noise reduction lowers the sound pressure level of operation sounds, but does not completely solve problems of "harshness" and "discomfort" caused by operation sounds.

Aside from the noise reduction technology, there has also been proposed a sound masking technology as a technology to lower a loud sound (to a less perceptible level). Sound masking is a method taking advantage of a phenomenon (sound masking effect) in which perception of a sound at a certain level makes other sounds barely audible, and this method is mainly classified into frequency masking and temporal masking. More specifically, a loud sound is superimposed with a sound (masker or masking sound) mainly similar in frequency band to the loud sound, so that the loud sound is made barely audible, thereby reducing harshness and discomfort.

As a conventional sound output device applying the sound masking technology, there is a noise masking device described in Japanese Patent Laid-Open Publication No. 9-193506. This noise masking device is provided in an image forming apparatus or suchlike with a drive mechanism generating a loud sound (noise) during operation, and the noise masking device includes a sound generator for generating a masking sound to mask the loud sound, and a masking sound control unit for controlling the sound generator to generate a masking sound within a frequency range including the main component frequency of the loud sound. The masking sound control unit allows the masking sound to be generated within a frequency range between the lower and upper limits of a critical frequency band for the main component frequency of the loud sound.

In order for the noise masking device to further reduce harshness and discomfort, the sound pressure level of the masking sound may need to be raised. However, this results in a problem of increasing the power level of the sounds (the masking sound and the operation sound) emitted by the image forming device.

SUMMARY OF THE INVENTION

In an embodiment of the present invention, a sound output device for masking an operation sound generated by equipment includes: an operation determining unit that determines an operation mode to be executed by the equipment; and a sound output unit that outputs a masking sound on the basis of the operation mode determined by the operation determining unit, the masking sound changing at least in sound pressure level over time.

BRIEF DESCRIPTION OF THE DRAWINGS

FIG. 6 is a frame format showing a masking sound held in a memory unit for each operation mode;

DETAILED DESCRIPTION OF THE PREFERRED EMBODIMENTS

Regarding Image Forming Apparatus

Figure 1:
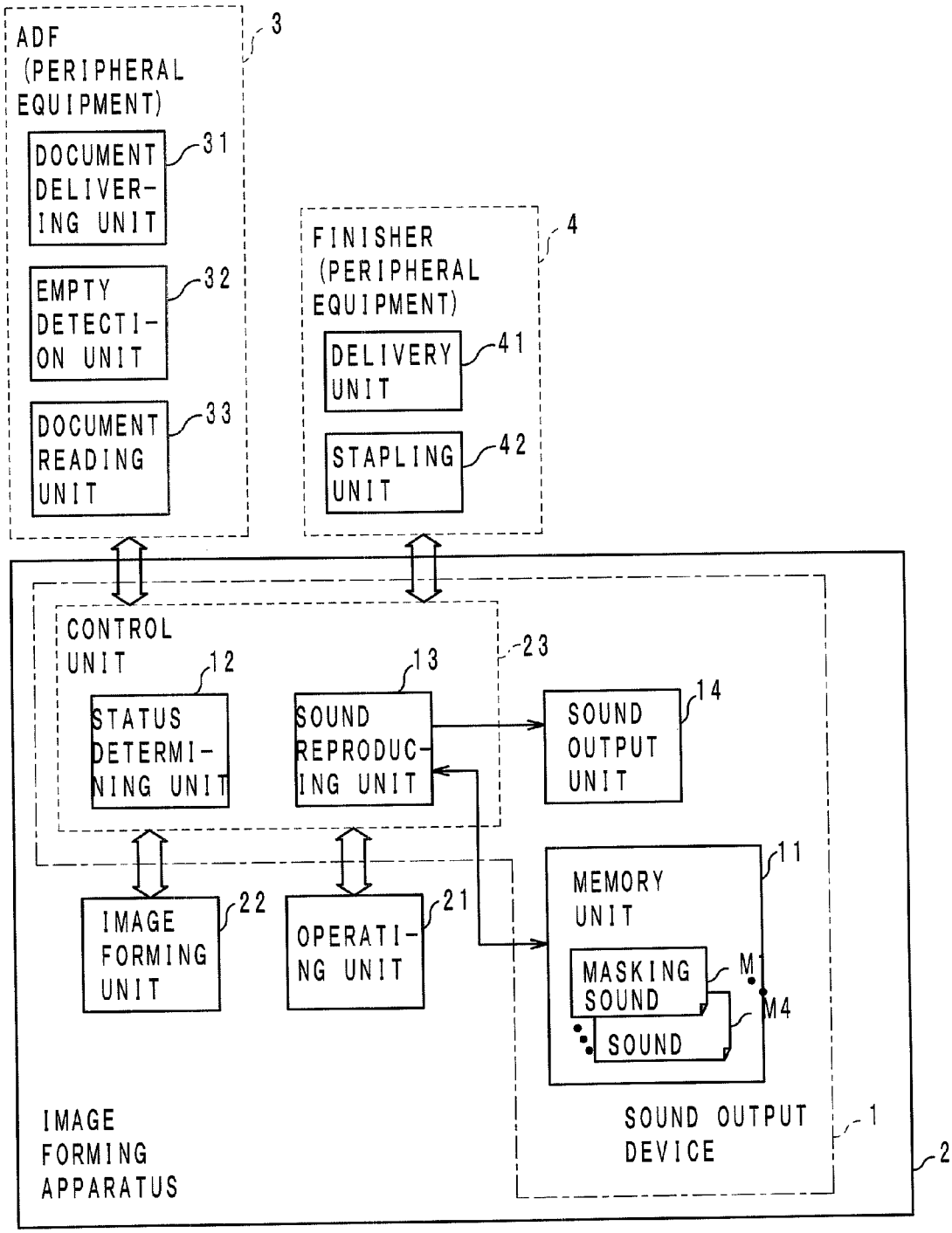
FIG. 1 is a block diagram illustrating the configuration of a sound output device according to an embodiment of the present invention.

Before describing a sound output device 1 according to an embodiment of the present invention, an image forming apparatus 2 will be described as an example of the equipment in which the sound output device 1 is provided. In FIG. 1, the image forming apparatus 2 is, for example, a multifunction peripheral, color printer, or suchlike, employing electrophotography with a tandem system, and generally includes an operating unit 21, an image forming unit 22, and a control unit 23.

The operating unit 21 is typically provided on the upper front of the image forming apparatus 2, and includes operating buttons and a touch panel to be pressed by the user. A typical exemplary operating button or suchlike is a print start button. In addition, the user operates the touch panel to select settings for stapling, for example. The operating unit 21 transmits a print start command, settings for stapling, or the like, to the control unit 23 in accordance with the user's operation.

In the image forming unit 22, a circumferential surface of a photoreceptor drum is charged by a charger, and thereafter irradiated by an optical system with an optical beam modulated with input image data. As a result, an electrostatic latent image is formed on the circumferential surface of the photoreceptor drum. Here, the image data is transmitted from, for example, a document reading unit 33 (to be described later) or a personal computer (not shown) connected to the image forming apparatus 2. Moreover, in the image forming unit 22, a developer supplies toner to the circumferential surface of the photoreceptor drum on which the electrostatic latent image is formed, thereby creating a toner image on the circumferential surface of the photoreceptor drum. In the image forming unit 22, a primary-transfer roller transfers the toner image on the circumferential surface of the photoreceptor drum to a transfer belt. The toner image is created for each of the colors of, for example, yellow (Y), magenta (M), cyan (C), and black (K). Such toner images are transferred onto one another on the transfer belt, so that a combined toner image is supported.

Furthermore, the image forming unit 22 receives a recording medium (e.g., paper) delivered from a supply tray (not shown). In the image forming unit 22, a secondary-transfer roller transfers the combined toner image on the transfer belt to the delivered recording medium. A fusing device heats and presses the recording medium fed from the secondary-transfer roller, thereby fixing the combined toner image onto the recording medium. In the case where a finisher 4 is not used, the recording medium subjected to the fixing process is ejected and placed as a print onto an output tray via an ejection roller of the image forming apparatus 2. Moreover, in the case where the finisher 4 is used, the recording medium subjected to the fixing process is delivered to the finisher 4.

The control unit 23 includes a CPU and main memory, and operates in accordance with a program stored in the main memory, thereby controlling the operation of components of the image forming unit 22 and peripheral equipment. In a specific example, the control unit 23 provides control signals to, for example, motors (not shown) for driving the components of the image forming unit 22.

Regarding Peripheral Equipment of Image Forming Apparatus

Next, the peripheral equipment of the image forming apparatus. 2 will be described. In the present embodiment, an automatic document feeder (ADF) 3 and the finisher 4 are described as examples of the peripheral equipment. The ADF 3 is provided on the image forming apparatus 2, and generally includes a document delivering unit 31, an empty detection unit 32, and a document reading unit 33. Under control of the control unit 23, the document delivering unit 31 delivers an image document placed on a tray of the ADF 3 to the document reading unit 33. The empty detection unit 32 typically includes a photosensor, and is provided on the tray of the ADF 3. The empty detection unit 32 outputs to the control unit 23 a detection signal indicating the presence or absence of an image document on the tray. The document reading unit 33 is an optical scanner, which reads the image document fed from the document delivering unit 31, generates image data represented by the three primary colors red (R), green (G), and blue (B), and transmits the data to the control unit 23 in the image forming apparatus 2. This RGB image data is converted by the control unit 23 into YMCK image data.

The finisher 4 is provided at the side of the image forming device 2, and generally includes a delivery unit 41 and a stapling unit 42. Upon reception of a recording medium subjected to a fixing process from the image forming device 2, the delivery unit 41 delivers the recording medium to the stapling unit 42 under control of the control unit 23. The stapling unit 42 loads delivered recording media therein and bundles the recording media. Thereafter, the stapling unit 42 staples the bundled recording media. Note that in addition to the stapling, the finisher 4 can perform various post-processing tasks on the recording media subjected to the fixing process, but such tasks depart from the scope of the present invention, and therefore any descriptions thereof will be omitted herein.

Regarding Sound Output Device

Next, the sound output device 1 will be described. The sound output device 1 is provided in the image forming apparatus 2, and includes a memory unit 11, a status determining unit 12, a sound reproducing unit 13, and a sound output unit 14, the status determining unit 12 and the sound reproducing unit 13 being incorporated in the control unit 23 in the form of, for example, software. Note that in the present embodiment, the sound output device 1 is described as being provided in the image forming apparatus 2, which is a printer, a copier, a fax machine, or an MFP incorporating such functions, but this is not restrictive, and the sound output device 1 can be provided in any equipment that emits an operation sound.

The memory unit 11 is typically a flash memory, and has stored therein data representing a plurality of masking sounds M (four masking sounds M1 to M4 are shown). The masking sounds M are assigned for their respective operation modes of the image forming device 2 to mask operation sounds (noise) generated through sequential operations in the operation modes. Specifically, each masking sound M is an artificial sound obtained by, for example, processing the frequency of an environmental sound or pink noise so as to have a frequency characteristic resembling that of the operation sound, and the masking sound M is incoherent to the user. Although the basic concept of masking is well known, it will be described in detail below with reference to FIG. 2, taking as an example the operation sound of the image forming apparatus 2.

Figure 2:
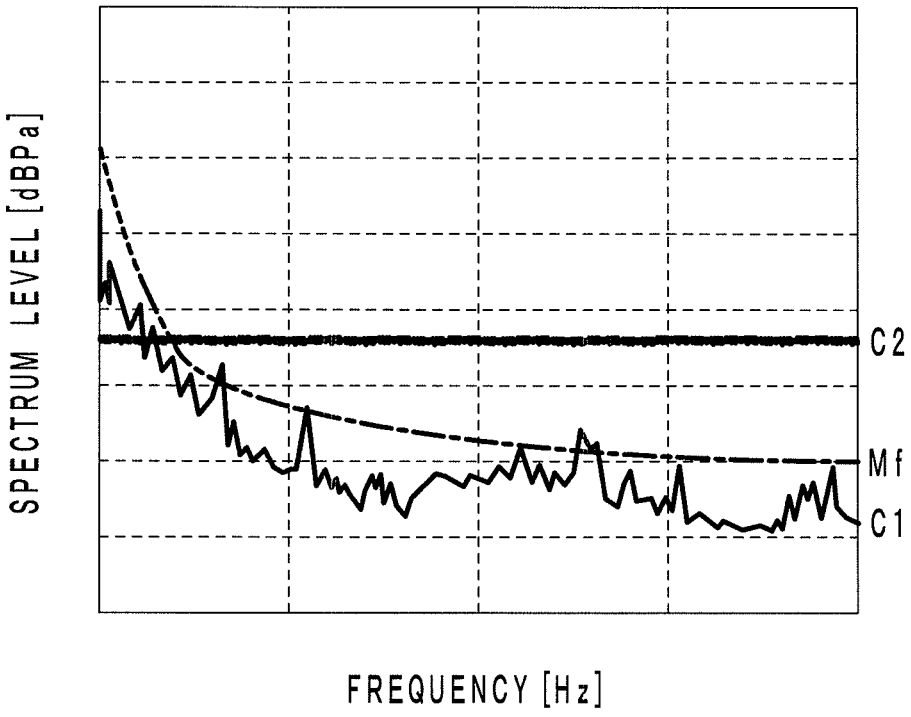
FIG. 2 is a graph showing the basic concept of masking.

In FIG. 2, the horizontal axis represents the frequency [Hz], and the vertical axis represents the spectrum level [dBPa]. The spectrum level is a sound pressure level for its corresponding frequency where frequency components of a sound are represented as a spectral distribution. Curve C1 indicates a frequency characteristic of an operation sound (noise) where the operation mode is "continuous printing" (print processing on a plurality of recording media). Further, curve C2 indicates a frequency characteristic of so-called white noise whose spectrum level is approximately constant regardless of the frequency. Furthermore, curve Mf indicates a frequency characteristic of a masking sound for the operation sound indicated by curve C1.

When an operation sound is superimposed with white noise, the sound leaves harshness in the ears of an observer, and in the case where the operation sound is superimposed with a masking sound, such harshness can be significantly reduced. The masking effect is increased by raising the sound pressure level of the masking sound, but this results in an increased sound pressure level of the sounds (the masking sound and the operation sound) emitted by the image forming device 2. To solve this problem, the present inventor conducted experiments, finding that a satisfactory masking effect can be achieved even in the case where an operation sound is superimposed with a masking sound having a sound pressure level correlated with changes in the sound pressure level of the operation sound over time. Hereinafter, specific examples of the masking sounds used in the present embodiment will be described with reference to FIGS. 3 and 4.

Figure 3:
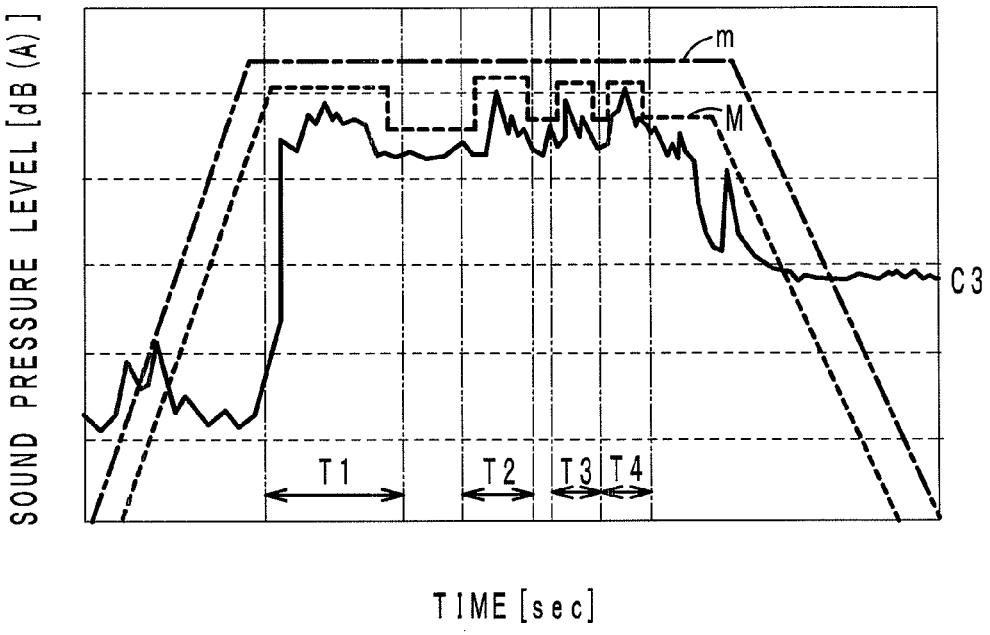
FIG. 3 is a graph showing a masking sound that changes in intensity over time in accordance with a sequential operation of an image forming device.
Figure 4A:
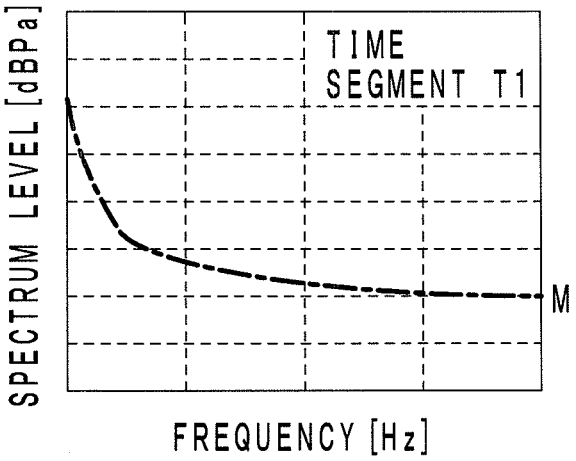
FIG. 4A is a graph showing a change in frequency characteristic of the masking sound over time in time segment T1.
Figure 4B:
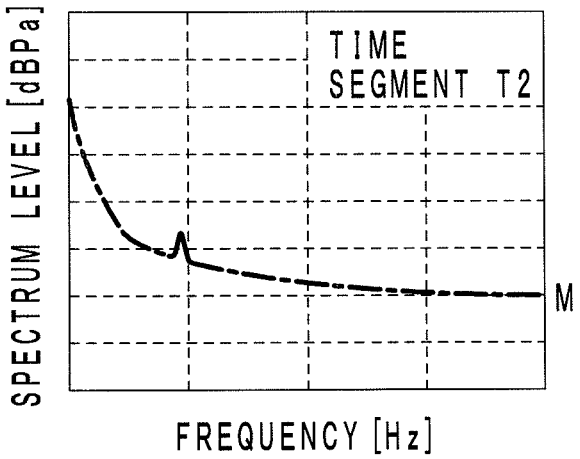
FIG. 4B is a graph showing a change in frequency characteristic of the masking sound over time in time segment T2.
Figure 4C:
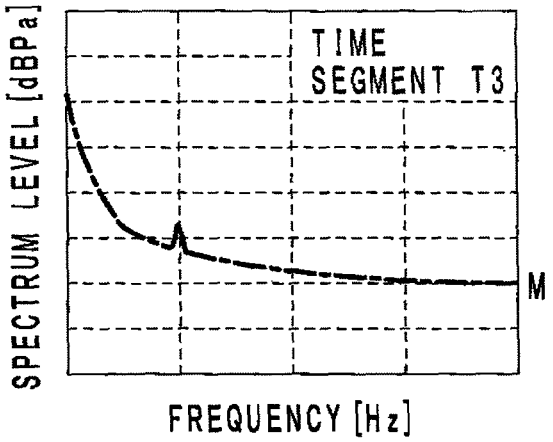
FIG. 4C is a graph showing a change in frequency characteristic of the masking sound over time in time segment T3.
Figure 4D:
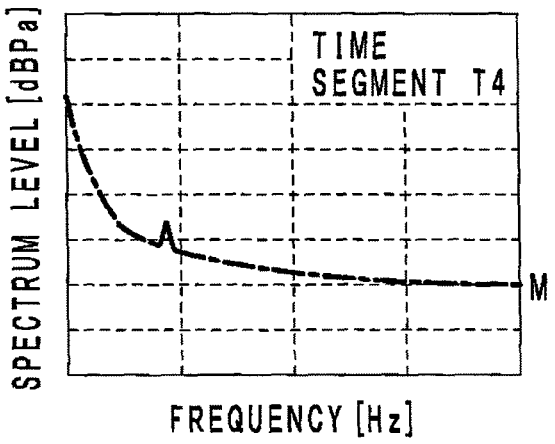
FIG. 4D is a graph showing a change in frequency characteristic of the masking sound over time in time segment T4.
Figure 5A:
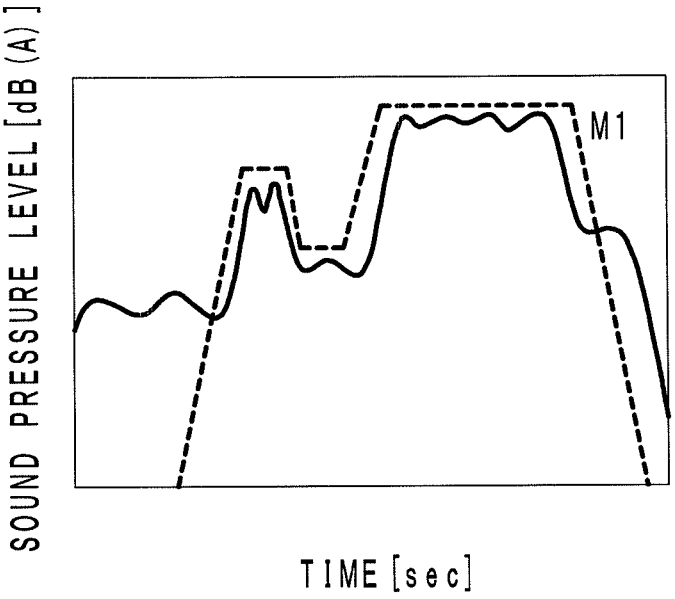
FIG. 5A is a graph showing changes in the masking sound over time where the operation mode is "single feed"
Figure 5B:
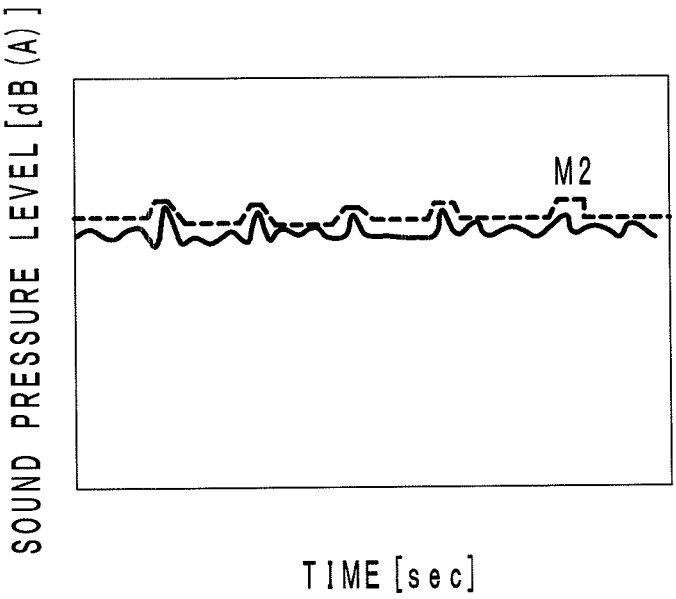
FIG. 5B is a graph showing changes in the masking sound over time where the operation mode is "continuous feed"
Figure 5C:
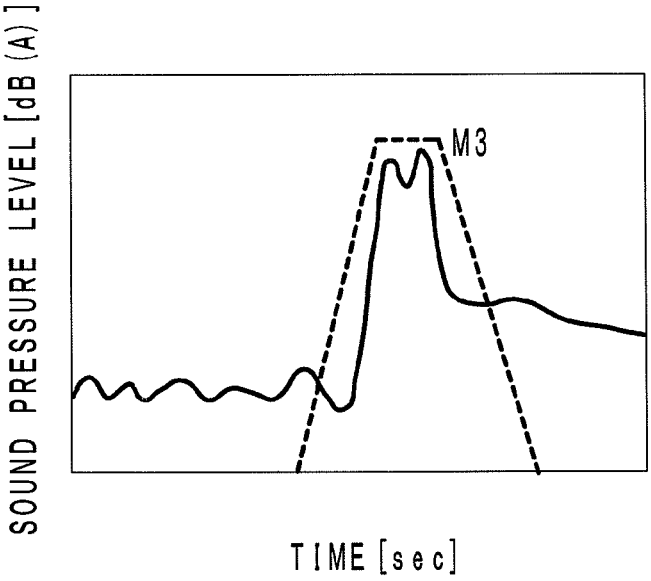
FIG. 5C is a graph showing changes in the masking sound over time where the operation mode is "ADF"
Figure 5D:
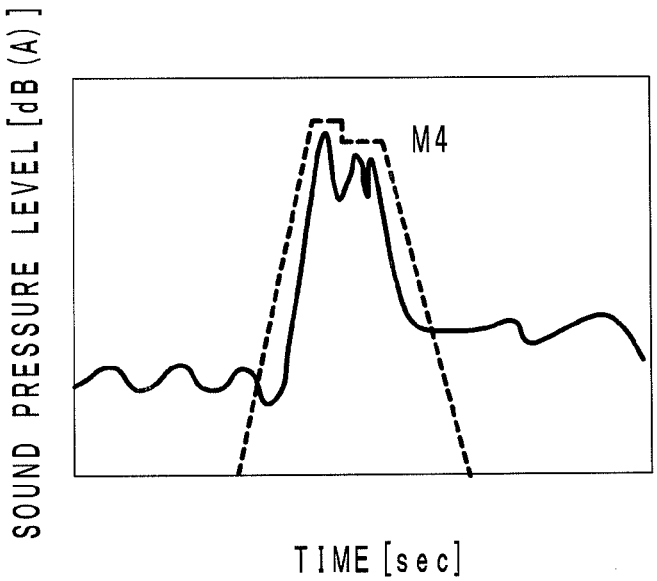
FIG. 5D is a graph showing changes in the masking sound over time where the operation mode is "finisher"

In FIG. 3, curve C3 indicates changes in the operation sound (noise) over time in the continuous printing mode. Before time segment T1 of curve C3, the image forming device 2 simply performs preparations including warm-up, and therefore the sound pressure level of the operation sound is relatively low. In time segments T1 through T4, a series of printing processing tasks, including recording medium supply, image formation, and recording medium ejection, are performed so that the sound pressure level of the operation sound rises. Moreover, the sound pressure level of the operation sound burstly rises due to collision noise almost cyclically produced by recording media being delivered. After time segment T4, since the main drive unit of the image forming device 2 has already stopped operating, the sound pressure level of the operation sound is relatively low.

The operation sound for the continuous printing mode is obtained through experiments by the supplier (manufacturer) before the image forming apparatus 2 is used by the user, and on the basis of the obtained operation sound, the masking sound M as shown is created.

For comparison with the masking sound M, a masking sound m, whose sound pressure level is constant in time segments T1 through T4, is shown in FIG. 3. The masking sound m can mask the operation sound as well. However, the masking sound m maintains that constant sound pressure level even in time periods where the sound pressure level of the operation sound is low (no sudden collision noise occurs), so that the power level of the sound emitted by the image forming device 2 might rise unnecessarily.

On the other hand, the masking sound M has such a time characteristic that the sound pressure level changes in accordance with changes in the operation sound over time in time segments T1 through T4. More specifically, the sound pressure level of the masking sound rises in timing with collision noise being caused by a recording medium, and falls when no collision noise occurs. Accordingly, by superimposing the operation sound with the masking sound M, the power level of the sound emitted by the image forming device 2 can be kept low.

Furthermore, the frequency of collision noise might vary among time segments T1 through T4. Therefore, the masking sound of the present embodiment preferably has a frequency characteristic which changes to conform to the frequency of collision noise, as shown in FIGS. 4A to 4D.

While the masking sound M has been described above in conjunction with the continuous printing mode, there are operation modes other than the continuous printing mode, including "single print", "ADF", and "finisher". The single print mode is an operation mode in which printing is performed on a single recording medium. The ADF mode is an operation mode in which the ADF 3 is activated to read an image document. The finisher mode is an operation mode in which the finisher 4 is activated to post-process the recording medium. For each of the operation modes also, the masking sound M is created in a similar manner to the above. Masking sounds M1 to $M_4$ for the single print mode, the continuous printing mode, the ADF mode, and the finisher mode have time waveforms as indicated by broken lines in FIGS. 5A to 5D, and masking sounds M1 to $M_4$ are stored in the memory unit 11, as shown in FIG. 6. Note that in FIGS. 5A to 5D, the time waveforms of the operation sounds for the single print mode, the continuous printing mode, the ADF mode, and the finisher mode are indicated by solid lines for reference.

Referring to FIG. 1 again, the status determining unit 12 determines the operation mode on the basis of a print start command and settings for stapling transmitted by the operating unit 21, a detection signal from the empty detection unit 32 provided in the ADF 3, etc.

Specifically, for example, when the number of sheets to be printed is determined to be one on the basis of the print start command, the current operation mode is determined to be the single print mode. When the number of sheets is two or more, the operation mode is determined to be the continuous printing mode. In addition, when the settings for stapling are received, it is determined that the finisher mode is combined with the continuous printing mode. Moreover, when the detection signal from the empty detection unit 32 is received, the current operation mode is determined to be the ADF mode. Here, the ADF mode may be executed before the single print mode or the continuous printing mode or may be executed in parallel while the single print mode or the continuous printing mode is being executed.

The sound reproducing unit 13 receives the result of operation mode determination from the status determining unit 12, reads the masking sound M that corresponds to the received result, from the memory unit 11, and causes a speaker acting as a sound output unit 14 to output that masking sound M. For example, in the case of the single print mode, masking sound M1 is read and outputted. Also, in the case of the continuous printing mode, masking sound M2 is read and outputted. Likewise, in the case of the continuous printing mode in combination with the finisher mode, masking sounds M2 and $M_4$ are read and outputted. Here, the control unit 23 knows the operation timing of the image forming unit 22 and the finisher 4, and therefore can output masking sounds M2 and $M_4$ at appropriate times, specifically, masking sound M2 being outputted first, and output of masking sound $M_4$ being started later during the outputting of masking sound M2. Furthermore, in the case of the ADF mode, masking sound M3 is read and outputted with masking sound Ml or M2 for the single print mode or the continuous printing mode being superimposed therewith.

Modification

In the foregoing, in the case of the continuous printing mode in combination with the finisher mode, masking sounds M2 and M4 are outputted in synchronization with the operation timing of the image forming unit 22 and the finisher 4. When masking sounds M2 and M4 for the two modes are superimposed and outputted, the power level of the sounds emitted by the image forming device 2 and its peripheral equipment might rise. To deal with this, the memory unit 11 may have stored therein combined masking sound M5 for the two modes with the sound pressure level optimized (see the last row of FIG. 6), and the sound reproducing unit 13 may read and reproduce combined masking sound M5. Likewise, the memory unit 11 may also have stored therein a combined masking sound for other operation modes.

Figures 7A, 7B:
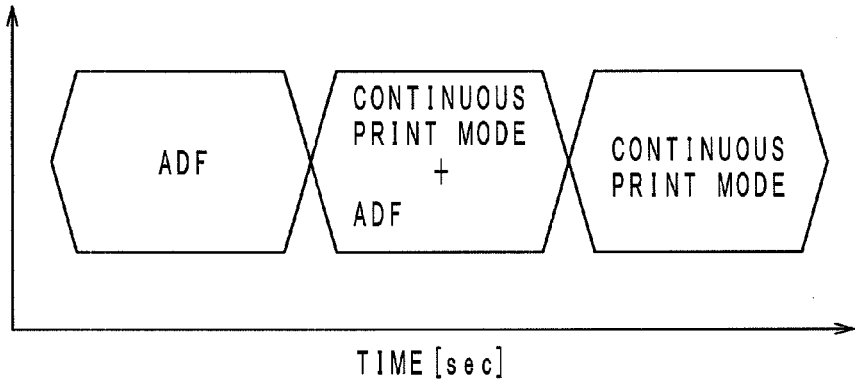
FIG. 7A is a diagram showing transition of operation modes according to a modification.
FIG. 7B is a table showing the contents of combined masking sounds according to the modification.

Furthermore, for example, the operation mode for continuous printing where the ADF 3 is used might transition in the order: the ADF mode; both the ADF mode and the continuous printing mode; and the continuous printing mode, as shown in FIG. 7A. Here, the status determining unit 12 determines the timing of starting/ending the ADF mode, on the basis of a detection signal from the empty detection unit 32, and also determines the timing of starting the continuous printing mode, on the basis of the warm-up time of the image forming device 2, the arrival time of image data from the ADF 3, etc. Further, the timing of ending the continuous printing mode is determined on the basis of the number of documents, etc. Considering in advance such transition of the operation mode, in addition to masking sounds M2 and M3 as mentioned above, the memory unit 11 may have stored therein combined masking sound $M_6$ for the ADF mode and the continuous printing mode with the sound pressure level optimized (see FIG. 7B), and each time the result of determination from the status determining unit 12 changes, the sound reproducing unit 13 may read the masking sound that corresponds to the current operation mode, from the memory unit 11, and may cause the sound output unit 14 to output that masking sound.

Actions and Effects of Sound Output Device

As described above, in the embodiment of the present invention, the memory unit 11 has a plurality of pre-created masking sounds M stored therein. The masking sounds M at least change in sound pressure level over time in accordance with the operation modes executable by the image forming device 2 and its peripheral equipment. The sound reproducing unit 13 reads a masking sound M in accordance with an operation mode determined by the status determining unit 12, and causes the sound output unit 14 to output the masking sound M. In this manner, the sound pressure level of the masking sound M changes over time in accordance with the operation mode, so that harshness and discomfort of the sound emitted by equipment can be reduced while lowering the power level of that sound.

Although the present invention has been described in connection with the preferred embodiment above, it is to be noted that various changes and modifications are possible to those who are skilled in the art. Such changes and modifications are to be understood as being within the scope of the invention.

What is claimed is:

1. A sound output device for masking an operation sound generated by equipment, the sound output device comprising:

a memory unit that stores, in advance, a plurality of masking sounds corresponding to operation sounds generated in a plurality of operation modes that are executable by the equipment, respectively, each of the masking sounds changing in sound pressure level over time in correspondence with each of said corresponding operation sounds;

an operation determining unit that determines which of the operation modes is to be executed by the equipment;

a selecting unit that selects at least one of the masking sounds stored in the memory unit in advance, based on the operation mode determined by the operation determining unit;

a sound reproducing unit that reads the selected masking sound from the memory unit; and a sound output unit that outputs the selected masking sound read by the sound reproducing unit from the memory unit, wherein:

the sound output unit outputs the masking sounds corresponding to respective operation modes determined by the operation determining unit, the masking sounds changing differently in sound pressure level over time, wherein the selecting unit selects, from among the masking sounds stored in the memory unit, the masking sound corresponding to the operation mode determined by the operation determining unit, and the sound reproducing unit reads the selected masking sound from the memory unit, and causes the sound output unit to output the read masking sound, and wherein the selecting unit selects a plurality of the masking sounds from the memory unit, based on operation modes determined by the operation determining unit, and the sound reproducing unit reads the selected plurality of the masking sounds from the memory unit and causes the sound output unit to output said plurality of the masking sounds.

2. The sound output device according to claim 1, wherein the masking sounds stored in advance in the memory unit further change in frequency over time.

3. The sound output device according to claim 1, wherein the operation determining unit determines the operation mode to be executed by the equipment based on a user operation or a status of the equipment.

4. The sound output device according to claim 1, wherein when the operation mode determined by the operation determining unit changes while the sound output unit is outputting a masking sound, the selecting unit selects another masking sound corresponding to the current operation mode from the memory unit, and the sound reproducing unit reads said selected another masking sound from the memory unit and causes the sound output unit to output said another masking sound.

5. The sound output device according to claim 1, wherein the equipment is an image forming apparatus.

6. The sound output device according to claim 1, wherein the equipment is peripheral equipment of an image forming apparatus.

7. A sound output device for masking an operation sound generated by equipment, the sound output device comprising:

a memory unit that stores, in advance, a plurality of masking sounds corresponding to operation sounds generated in a plurality of operation modes that are executable by the equipment, respectively, each of the masking sounds changing in sound pressure level over time in correspondence with each of said corresponding operation sounds;

an operation determining unit that determines which of the operation modes is to be executed by the equipment;

a selecting unit that selects at least one of the masking sounds stored in the memory unit in advance, based on the operation mode determined by the operation determining unit;

a sound reproducing unit that reads the selected masking sound from the memory unit; and a sound output unit that outputs the selected masking sound read by the sound reproducing unit from the memory unit, wherein:

the selecting unit selects two or more of the plurality of masking sounds stored in the memory unit in advance, based on the operation mode determined by the operation determining unit; and the sound reproducing unit causes the sound output unit to output the selected two or more masking sounds in combination.

8. The sound output device according to claim 1, wherein the plurality of masking sounds stored in the memory unit in advance change in sound pressure levels over time in different manners, respectively.

9. The sound output device according to claim 1, wherein the plurality of operation modes executable by the equipment correspond to operations that can be performed by the equipment, respectively.

10. A sound output device for masking an operation sound generated by equipment, the sound output device comprising:

a memory unit that stores, in advance, a plurality of masking sounds corresponding to operation sounds generated in a plurality of operation modes that are executable by the equipment, respectively, each of the masking sounds changing in sound pressure level over time in correspondence with each of said corresponding operation sounds;

an operation determining unit that determines which of the operation modes is to be executed by the equipment;

a selecting unit that selects at least one of the masking sounds stored in the memory unit in advance, based on the operation mode determined by the operation determining unit;

a sound reproducing unit that reads the selected masking sound from the memory unit; and a sound output unit that outputs the selected masking sound read by the sound reproducing unit from the memory unit, wherein the memory unit stores, in advance, a combined masking sound corresponding to two or more of the masking sounds which respectively correspond to operations modes which are executable by the equipment concurrently, the combined masking sound having a sound pressure level which is optimized relative to the sound pressure levels of the corresponding two or more masking sounds.

* * * * *